US009638209B1

(12) United States Patent
Cogley

(10) Patent No.: US 9,638,209 B1
(45) Date of Patent: May 2, 2017

(54) CEILING FAN BLADE ATTACHMENT

(71) Applicant: Van Scott Cogley, Fort Walton Beach, FL (US)

(72) Inventor: Van Scott Cogley, Fort Walton Beach, FL (US)

( * ) Notice: Subject to any disclaimer, the term of this patent is extended or adjusted under 35 U.S.C. 154(b) by 0 days.

(21) Appl. No.: 14/794,215

(22) Filed: Jul. 8, 2015

(51) Int. Cl.
*F04D 29/38* (2006.01)
*F04D 25/08* (2006.01)
*F04D 29/64* (2006.01)

(52) U.S. Cl.
CPC ..... *F04D 29/388* (2013.01); *F04D 25/088* (2013.01); *F04D 29/644* (2013.01)

(58) Field of Classification Search
CPC .... F04D 29/388; F04D 29/382; F04D 25/088; F04D 27/008; F01D 5/14; E06B 7/205
USPC ..... 416/62, 240, 248
See application file for complete search history.

(56) References Cited

U.S. PATENT DOCUMENTS 1,055,947 A 3/1913 Schwartzberg
1,545,560 A 7/1925 Heath
2,014,032 A 9/1935 Sharpe et al.
2,032,224 A * 2/1936 Paton ..... 416/140
2,157,999 A 5/1939 Charavay
2,990,889 A 7/1961 Welch
4,012,168 A * 3/1977 Spellman ..... 416/132 A
4,037,987 A * 7/1977 Charles et al. ..... 416/132 A
4,172,693 A * 10/1979 Barton et al. ..... 416/132 A
4,187,055 A * 2/1980 Barnstead ..... 416/132 A
4,662,823 A * 5/1987 Cooke ..... 416/23
4,892,460 A * 1/1990 Volk ..... F04D 29/388 416/23
5,328,329 A 7/1994 Monroe
5,725,355 A * 3/1998 Crall et al. ..... 416/229 A
6,183,201 B1 * 2/2001 Maby ..... 416/170 R
7,210,910 B1 * 5/2007 Parker et al. ..... 416/243
7,393,183 B2 7/2008 Keller
7,399,159 B2 7/2008 Matheny et al.
D587,799 S 3/2009 Oleson
7,665,967 B1 * 2/2010 Parker et al. ..... 416/62
7,927,071 B2 4/2011 Parker et al.
8,079,823 B2 12/2011 Aynsley
8,147,204 B2 4/2012 Scherer et al.
8,162,613 B2 4/2012 Oleson et al.
D672,868 S 12/2012 Williams
8,529,212 B2 9/2013 Smith et al.
8,821,126 B2 * 9/2014 Oleson et al. ..... 416/210 R
D723,678 S 3/2015 Strecker et al.
(Continued)

FOREIGN PATENT DOCUMENTS

WO WO 2009148953 A1 * 12/2009

*Primary Examiner* — Dwayne J White
*Assistant Examiner* — Su Htay
(74) *Attorney, Agent, or Firm* — Peter Loffler

(57) ABSTRACT

An attachment that attaches to the trailing edge of a ceiling fan blade has a curved and flexible dam that curves rearwardly from the trailing edge and downwardly from a lower surface of the fan blade. When the ceiling fan is operational and fan blades are rotating, the curved dam interacts with the air moved by the fan blade and directs the air in a downwardly direction toward the occupants of the room where the fan is installed. At increased fan speeds, the dam flattens out, decreasing any additional load placed on the motor of the fan by the downwardly curved dam. One attachment is attached to each of the blades of the fan.

10 Claims, 4 Drawing Sheets

(56) References Cited

U.S. PATENT DOCUMENTS

| | | | | |
|---|---|---|---|---|
| 2008/0014090 | A1 | 1/2008 | Aynsley et al. | |
| 2008/0213097 | A1 | 9/2008 | Oleson et al. | |
| 2012/0128501 | A1 | 5/2012 | Hoofard et al. | |
| 2012/0177500 | A1 | 7/2012 | Oleson et al. | |
| 2013/0129519 | A1* | 5/2013 | Nielsen | F03D 1/0633 416/228 |
| 2014/0154083 | A1* | 6/2014 | Chelf | 416/193 R |

* cited by examiner

CEILING FAN BLADE ATTACHMENT

BACKGROUND OF THE INVENTION

1. Field of the Invention

The present invention relates to an air dam that attaches to the trailing edge of a ceiling fan blade and acts as a spoiler in order to redirect the turbulent airflow created by the rotating fan blade in a downward direction.

2. Background of the Prior Art

Ceiling fans are used to create downward air flow in order to help cool occupants of a room wherein the ceiling fan is located. Ceiling fans can be used alone or can be used to supplement the cooling air emitted by an air conditioning system. The ceiling fan has one or more ceiling fan blades that rotate under the action of a motor held within the ceiling fan housing. The leading edge of the rotating ceiling fan blade has a downward angle of attack that directs the downward air flow. The more air flow, the more cooling capacity delivered by the ceiling fan.

Some ceiling fan manufacturers design fan blades that deliver the maximum air flow at varying speeds of rotation and fan blade size. Yet these blades tend to be utilitarian in appearance and are not well received by the consuming public. Accordingly, many ceiling fan manufacturers place a premium on aesthetics of the overall ceiling fan design, including the appearance of the fan blades, and worry less about air movement efficiency of the fan blades used by the ceiling fan. As such, a person may install a ceiling fan that harmonizes with the decor of the room into which the fan is installed, only to have a ceiling fan that delivers less than an ideal air flow toward the occupants of the room where the ceiling fan is installed. Such a fan either moves little air at slow speeds or directs much of the air being moved in a lateral as opposed to a downward direction. The user is then forced to increase the fan speed in order to reach a desired comfort level, with the attendant increase in fan noise and electricity use. As such discoveries are typically made after the ceiling fan is purchased and installed, the person must accept a less than ideal situation.

To address such problems, devices have been proposed that increase the air flow of a ceiling fan's blades during rotation. Some such devices are attached to either the leading edge and/or trailing edge of the rotating fan blades in order to alter the geometry of the fan blade so as to increase the volume of air moved for a given rotational speed. Similarly, some prior art devices add wing tips to the distal ends of the ceiling fan blade for a similar purpose. Such prior art devices, which come in a multitude of architectures, may move a greater volume of air, but not without compromise. The increase in air movement corresponds to a greater load on the ceiling fan motor due to the increased drag and additional weight of the altered blade. Some prior art devices, in order to move a greater volume of air, transform the ceiling fan blade into more of an airfoil shape so that substantial Bernoulli-type lift is created which increases the load on the motor, thereby decreasing fan efficiency. Many prior art devices are large, bulky and unattractive.

What is needed is a device that increases a ceiling fan's efficiency while addressing the above mentioned shortcomings found in the art. Such a device should not substantially increase the loading on the motor of the ceiling fan blade by substantially increasing the volume of air moved by the blades. Rather, such a device should have a directional effect so as to direct the air that is being moved by the rotating fan blades in a downwardly direction toward the occupants of the room whereat the ceiling fan is installed. Such a device must not transform the fan blade into an airfoil shape or otherwise impact substantial Bernoulli-type lift, either positive or negative, onto the fan blade.

SUMMARY OF THE INVENTION

The ceiling fan blade attachment of the present invention addresses the aforementioned needs in the art by providing a device that quickly and easily attaches to a rotating fan blade of a ceiling fan and directs the air that is being moved by the rotating fan blade in a downward direction. The ceiling fan blade attachment does not alter the fan blade's geometry and does not turn the fan blade into an airfoil shape capable of generating substantial Bernoulli-type lift and therefore does not increase the potential for fan failure. The ceiling fan blade attachment does not significantly impact the loading on the motor. The ceiling fan blade attachment is of relatively simple design and construction, being produced using standard manufacturing techniques, so that the device is relatively inexpensive to produce so as to make the device economically attractive to potential consumers for this type of device.

The ceiling fan blade attachment of the present invention is comprised of a base that has a first end and a second end. A shoulder has third end extending from the second end of the base and a fourth end. The base and shoulder may be oriented generally normal to one another. A curved dam has a fifth end extending from the fourth end of the shoulder and a sixth end. The dam also has an upper surface and a lower surface. The base is attached to an upper surface of a fan blade so that the shoulder abuts a trailing edge (the edge that trails during fan blade movement) of the fan blade. As such, the dam extends rearwardly from the trailing edge of the fan blade and downward from a lower surface of the fan blade. The base is attached to the upper surface of the fan blade via an adhesive. The upper surface of the dam has a first radius of curvature that is constant while the lower surface of the dam has a second radius of curvature that is also constant. The dam is made from a flexible material. The lower surface of the fan blade and the lower surface of the dam form a smooth surface.

BRIEF DESCRIPTION OF THE DRAWINGS

Similar reference numerals refer to similar parts throughout the several views of the drawings.

DESCRIPTION OF THE PREFERRED EMBODIMENT

Figure 1:
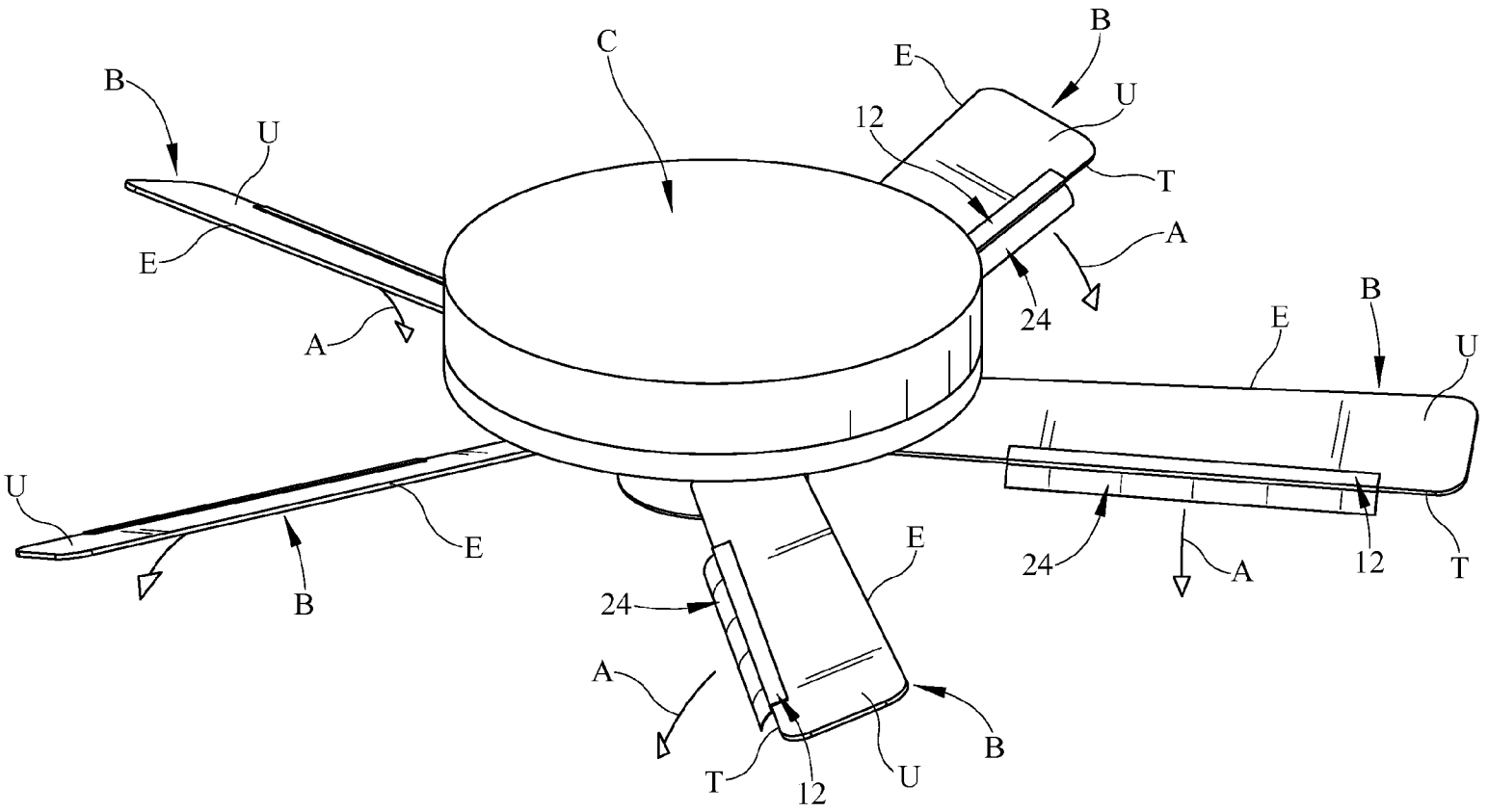
FIG. 1 is top perspective view of the ceiling fan blade attachment of the present invention attached to a ceiling fan.
Figure 2:
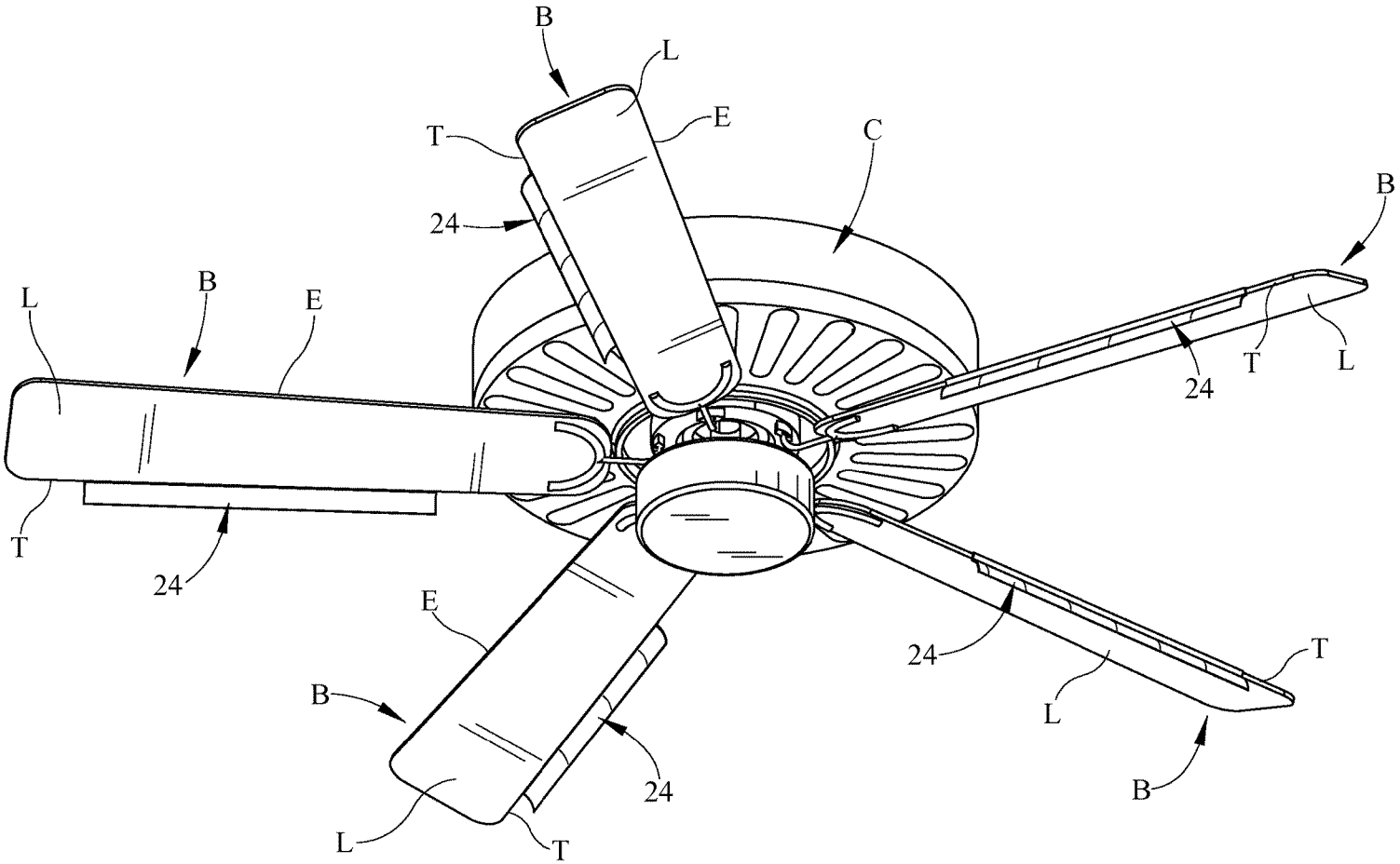
FIG. 2 is a bottom perspective view of the ceiling fan blade attachment attached to the ceiling fan.
Figure 3:
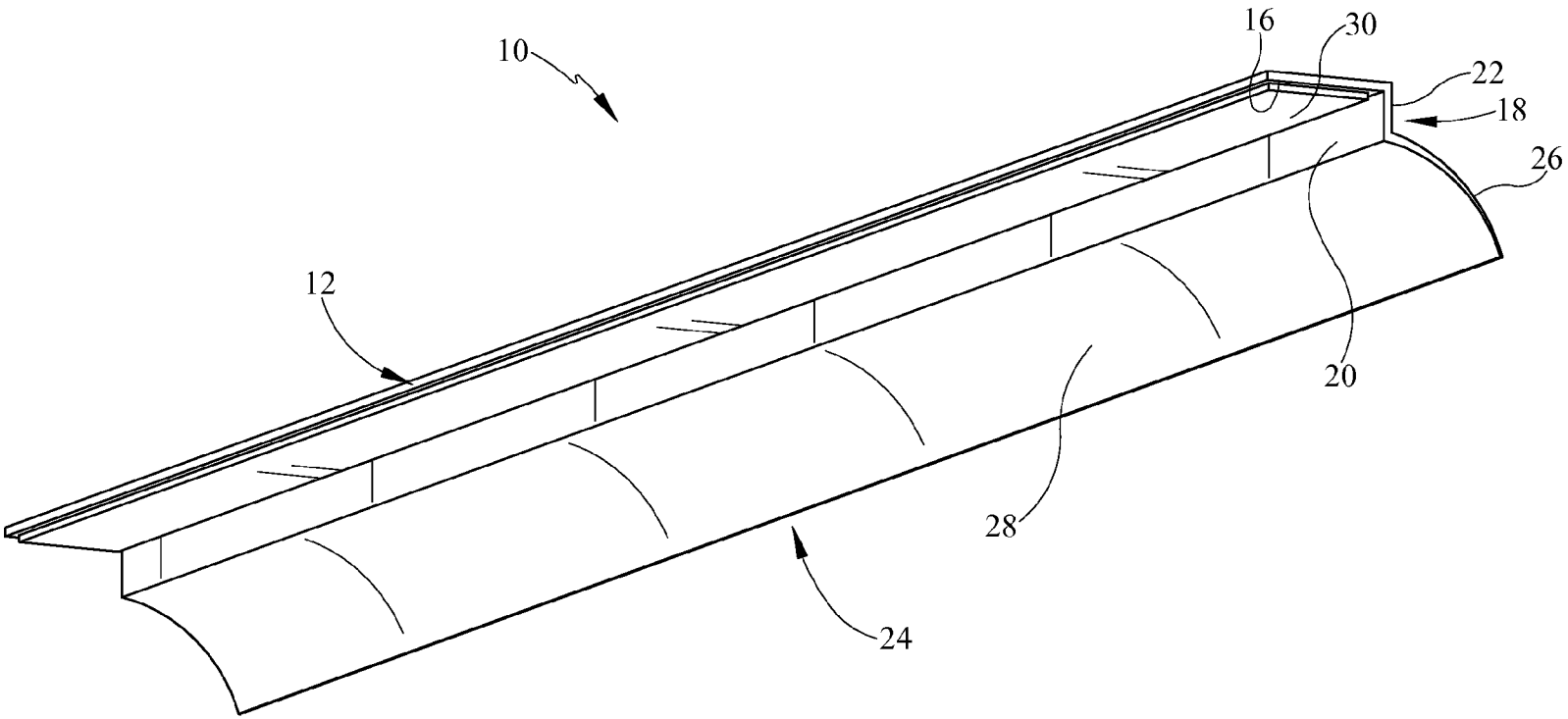
FIG. 3 is a lower perspective view of the ceiling fan blade attachment.
Figure 4:
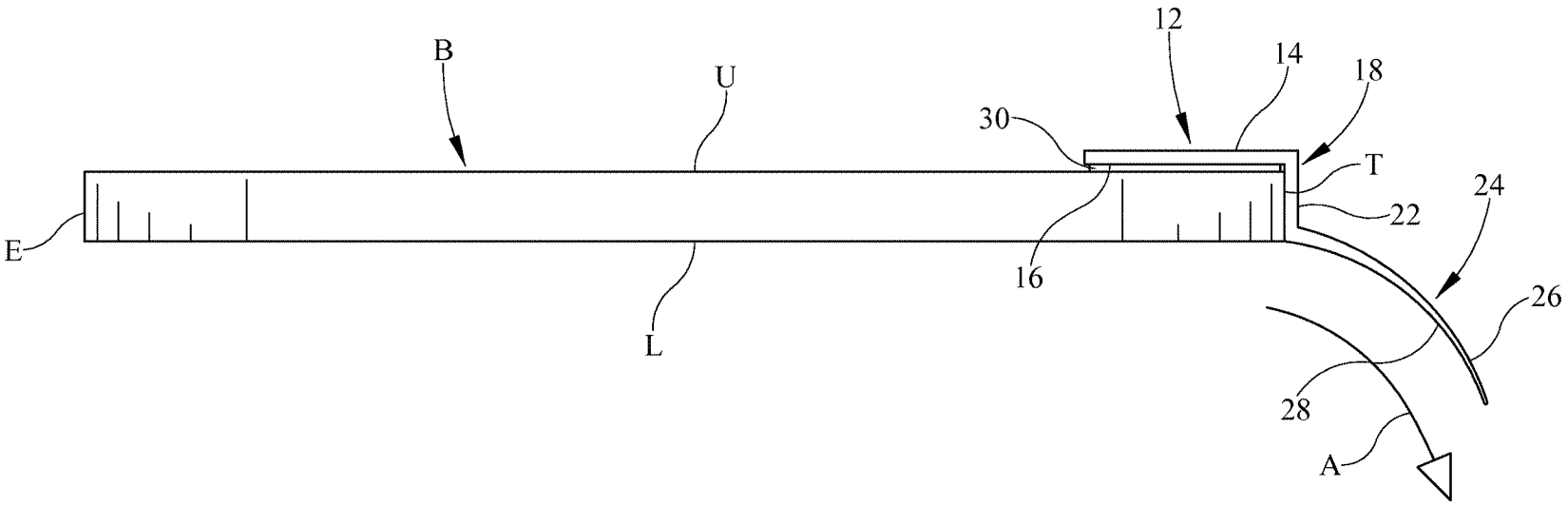
FIG. 4 is a side view of the ceiling fan blade attachment attached to a ceiling fan blade.

Referring now to the drawings, it is seen that the ceiling fan blade attachment of the present invention, generally denoted by reference numeral 10, is an elongate member that is comprised of a base 12 having an top surface 14 and a bottom surface 16, a shoulder 18 having an inside surface 20 and an outside surface 22, and a curved dam 24 having a convex upper surface 26 and a concave lower surface 28. As seen, the curvature of both the upper surface 26 and lower surface 28 of dam 24 so as to not create lift when interacting with an air flow A and may, but need not necessarily be of uniform thickness, or, as seen of a tapering thickness in proceeding toward the dam's distal end. Ideally, the dam 24 is resilient so as to easily flex when a load is applied especially a wind load applied to the lower surface 28 thereof. As such, the dam 24 is made from a resilient material such as flexible plastic or rubber. Therefore, either the shoulder 18 and the base 12 are also made from such a resilient material and the base 12, shoulder 18, and dam 24 are unitary, indeed possibly monolithic, or the base 12 and the shoulder 18 are made from a relatively rigid material (possibly as a single monolithic unit), such as rigid plastic, or even a ceramic or a metal such as aluminum and the resilient dam 24 is attached to the end of the shoulder 18 in appropriate fashion depending on the materials used, or the base 12 and shoulder 18 and the dam 24 can be co-extruded from their respective materials.

As seen, an adhesive 30 is located on the bottom surface 16 of the base 12. A protective peel strip (not illustrated) may be located on the adhesive 30 prior to installation of the ceiling fan blade attachment 10 onto a ceiling fan C as is well known in the art.

A fan blade B has an upper surface U and a lower surface L, a leading edge E and a trailing edge T and is attached to the ceiling fan C in appropriate fashion.

The ceiling fan blade attachment 10 is installed by removing the peel strip from the adhesive and adhesively attaching the ceiling fan blade attachment 10 to the fan blade B by positioning the adhesive-laden bottom surface 16 of the base 12 onto the upper surface U of the fan blade B at the trailing edge T so that the inside surface 20 of the shoulder 18 abuts the trailing edge T of the fan blade B. The adhesive 30 used may be a pressure sensitive adhesive that has sufficient peel strength to withstand the shear forces acting on the ceiling fan blade attachment 10 during fan blade B movement. The adhesive 30 may but need not necessarily form a permanent bond between the base 12 and the fan blade B. As seen, when the ceiling fan blade attachment 10 is attached to the fan blade B, the lower surface L of the fan blade B and the lower surface 28 of the dam form a smooth surface, which means that there is neither a step up nor a step down when transitioning between the lower surface L of the fan blade B and the lower surface 28 of the dam 24. A smooth surface reduces the efficiency robbing turbulence which would be occasioned by a non-smooth surface (step up or step down) when transitioning between the lower surface L of the fan blade B and the lower surface 28 of the dam 24).

A ceiling fan blade attachment 10 is attached to each fan blade B of the ceiling fan C as described above.

When the ceiling fan C rotates its fan blades B, the fan blades B generate air flow A in their normal fashion. The dam 24 captures the air flow A that is flowing laterally and directs (spoils) the air flow A downwardly toward the occupants of the room beneath the ceiling fan C. While the ceiling fan C moves the same amount of air as without the ceiling fan blade attachment 10 installed on each fan blade B, the air flow A is directed in a much more targeted and efficient direction toward the room occupants thereby increasing the comfort level for the occupants at a given ceiling fan C speed.

As the speed of rotation of the fan blades B increases, whenever the ceiling fan's motor speed is increased, the dam 24, by being flexible, flexes rearwardly toward a more horizontal angle with respect to the lower surface U of the fan blade B so as to reduce the loading on the motor by the dam 24.

While the invention has been particularly shown and described with reference to an embodiment thereof, it will be appreciated by those skilled in the art that various changes in form and detail may be made without departing from the spirit and scope of the invention.

I claim:

1. An attachment for attaching to a fan blade of a ceiling fan, the fan blade having a leading edge and a trailing edge and a first upper surface and a first lower surface, the attachment comprising:

a base having a first end and a second end;

a shoulder having a third end extending from the second end of the base, the shoulder also having a fourth end;

a curved dam having a fifth end extending from the fourth end of the shoulder, the dam also having a sixth end, a second upper surface and a second lower surface; and such that the base is adapted to be attached to the first upper surface of the fan blade so that the shoulder abuts the trailing edge of the fan blade so that the dam extends rearwardly from the trailing edge of the fan blade and downward from the lower surface of the fan blade and wherein the shoulder is dimensioned so that first lower surface of the fan blade at the trailing edge of the fan blade and the second lower surface of the dam form a smooth transition when the attachment is made to the fan blade.

2. The attachment as in claim 1 wherein the base has an adhesive thereon so that the base is attached to the first upper surface of the fan blade via the adhesive.

3. The attachment as in claim 1 wherein the second upper surface of the dam has a first radius of curvature that is constant.

4. The attachment as in claim 3 wherein the second lower surface of the dam has a second radius of curvature that is constant.

5. The attachment as in claim 1 wherein the dam is made from a flexible material.

6. The attachment as in claim 1 in combination with the fan blade.

7. The attachment as in claim 6 wherein the base has an adhesive thereon so that the base is attached to the first upper surface of the fan blade via the adhesive.

8. The attachment as in claim 6 wherein the second upper surface of the dam has a first radius of curvature that is constant.

9. The attachment as in claim 8 wherein the second lower surface of the dam has a second radius of curvature that is constant.

10. The attachment as in claim 6 wherein the dam is made from a flexible material.

* * * * *